US007628385B2

(12) United States Patent
Laird

(10) Patent No.: US 7,628,385 B2
(45) Date of Patent: Dec. 8, 2009

(54) FENCE EDGE GUARD

(76) Inventor: Morris Laird, 220 Woodside Cres NW., Airdric, Alberta (CA) T4B 2G8

( * ) Notice: Subject to any disclaimer, the term of this patent is extended or adjusted under 35 U.S.C. 154(b) by 0 days.

(21) Appl. No.: 12/112,809

(22) Filed: Apr. 30, 2008

(65) Prior Publication Data

US 2009/0272954 A1 Nov. 5, 2009

(51) Int. Cl.
*E04H 17/00* (2006.01)

(52) U.S. Cl. ..... 256/1; 256/32

(58) Field of Classification Search ..... 256/1, 256/32

See application file for complete search history.

(56) References Cited

U.S. PATENT DOCUMENTS

| | | | | |
|---|---|---|---|---|
| 3,713,624 | A | | 1/1973 | Niemann |
| 3,991,980 | A | | 11/1976 | Blackburn |
| 4,399,863 | A | * | 8/1983 | Banasiuk ..... 165/9 |
| 4,497,472 | A | | 2/1985 | Johnson |
| 4,515,349 | A | | 5/1985 | Groves |
| 4,548,388 | A | | 10/1985 | Cobler |
| 4,663,883 | A | | 5/1987 | Hilliard et al. |
| 4,690,382 | A | | 9/1987 | Koperdak |
| 4,903,947 | A | | 2/1990 | Groves |
| 4,907,783 | A | | 3/1990 | Fisk et al. |
| 4,964,619 | A | | 10/1990 | Glidden, Jr. |
| 5,039,065 | A | | 8/1991 | Denton |
| 5,178,369 | A | | 1/1993 | Syx |
| D343,774 | S | | 2/1994 | Cox et al. |
| 5,328,156 | A | | 7/1994 | Hoke |
| 5,615,866 | A | | 4/1997 | Kinnison |
| 6,070,859 | A | | 6/2000 | Damon et al. |
| 6,561,491 | B2 | | 5/2003 | Thompson et al. |
| 7,004,458 | B1 | | 2/2006 | Grubba et al. |

* cited by examiner

*Primary Examiner*—Victor MacArthur
(74) *Attorney, Agent, or Firm*—Maxey Law Offices, PLLC; Stephen Lewellyn

(57) ABSTRACT

A fence edge guard including an elongated channel-shaped body member having a bottom, and upstanding opposed sidewalls extending upwardly from opposed side edges of the bottom and terminating at an open top, and an interior elongated channel defined by the bottom and said sidewalls. A plurality of openings are longitudinally spaced along bottom. A plurality of spring means are spaced longitudinally along the body for securing the body along the bottom edge of a chain link fence such that the bottom of the fence edge guard is urged upwardly towards the bottom edge of the chain link fence. The fence edge guard is useful in preventing vegetation from growing through the opens of the chain link fence, preventing damage and excess wear on line trimmer cutting lines, and for providing a gap between the bottom of the fence and the ground to permit trimming of vegetation below the fence.

4 Claims, 2 Drawing Sheets

FENCE EDGE GUARD

FIELD OF THE INVENTION

The present invention relates generally to fence guards, and more particularly, relating to fence edge guard that is positionable along the bottom edge of a chain link fence as a barrier to vegetation from growing through the openings of the fences and to prevent damage and excess wear on the cutting line of vegetation line trimmers.

BACKGROUND OF THE INVENTION

Chain link fences are quite frequently used to surround yard areas to either prevent access into the areas or to prevent access outside the areas, as they are long lasting and generally inexpensive when compared to wood, metal or plastic slat fences. However, ever since their first use, a problem with vegetation growing through the open spaces along the bottom edge of the fence has existed. This is a problem because the chemicals in the vegetation can cause the chain link fence to corrode more quickly, thick vegetation growth traps and retains water resulting in the corrosion, and the growth of the vegetation through the fence is widely recognized as being unpleasant appear.

With the introduction of the modern day line trimmer, wherein a spinning nylon, metal or plastic cutting line or string is used as a cutting blade to quickly and efficiently trim back vegetation growth, vegetation can somewhat be easily cut down and removed from the chain link fence. However, the open mesh of the chain line fence quickly wears away at the expensive cutting line resulting in excess wear and consumption, which is undesirable.

Edge guards for attachment to or for placement along the bottom edge of a chain link fence to serve as vegetation barriers and/or guards to prevent damage and excess wear on the cutting line of line trimmers are known. Various devices have been devised in the past to accomplish the above. These prior devices usually include a generally U-shaped channel that is positionable along the bottom edge of the fence with the bottom edge located between sidewalls of the channel to serve as vegetation barrier. Alternatively they usually include a horizontal surface that spreads out on both sides of the bottom of the fence and thus prevents the growth of vegetation along spaced distances from the bottom of the fence. Such prior devices are usually difficult to install and require tools or even specialized tools to install. Also, frequently these devices are expensive and labor intensive during installation. Additionally, these prior devices do not provide for a gap between the bottom of the device and the ground surface permitting trimming of vegetation between the bottom of the fence and the ground.

Accordingly, there is a need for an improved fence edge guard for providing a barrier against vegetation growth, and a guard against excess wear and consumption of the cutting line of a line trimmer that is easily installed, and provides a gap between the bottom of the fence and the ground surface.

SUMMARY OF THE INVENTION

Therefore, it is an object of the present invention to provide a fence edge guard for a chain link fence that provides a vegetation barrier and line trimmer guard for a chain link fence that is easy to install.

It is another object of the present invention to provide a fence edge guard for a chain link fence that does not require tools for installation.

It is another object of the present invention to provide a fence edge guard for a chain link fence that permits a gap between the fence bottom and the ground surface.

It is another object of the present invention to provide a fence edge guard for a chain link fence that prevents accumulation of water within the barrier.

It is another object of the present invention to provide a fence edge guard for a chain link fence that is attached to the fence using a spring biasing means to urge the guard upwards towards the fence.

It is another object of the present invention to provide a fence edge guard for a chain link fence that is easily manufactured from readily available materials using well established methods.

To achieve the above and other advantages, in general, in one aspect, a fence edge guard for installation along the bottom edge of a chain link fence to prevent damage to the cutting line of line trimmer and to prevent vegetation from growing up through the links of the fence is provided. The fence edge guard includes an elongated channel-shaped body member having a bottom, and upstanding opposed sidewalls extending upwardly from opposed side edges of the bottom and terminating at an open top, and an interior elongated channel defined by the bottom and the sidewalls. A plurality of longitudinally spaced openings along the bottom. A plurality of spring means spaced longitudinally along the body for securing the body along the bottom edge of a chain link fence such that the bottom is urged upwardly towards the bottom edge of the chain link fence. There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The accompanying drawings, which are included to provide further understanding of the invention and are incorporated in and constitute a part of this specification, illustrate preferred embodiments of the invention and together with the description serve to explain the principles of the invention, in which.

DETAILED DESCRIPTION OF THE INVENTION

Figure 1:
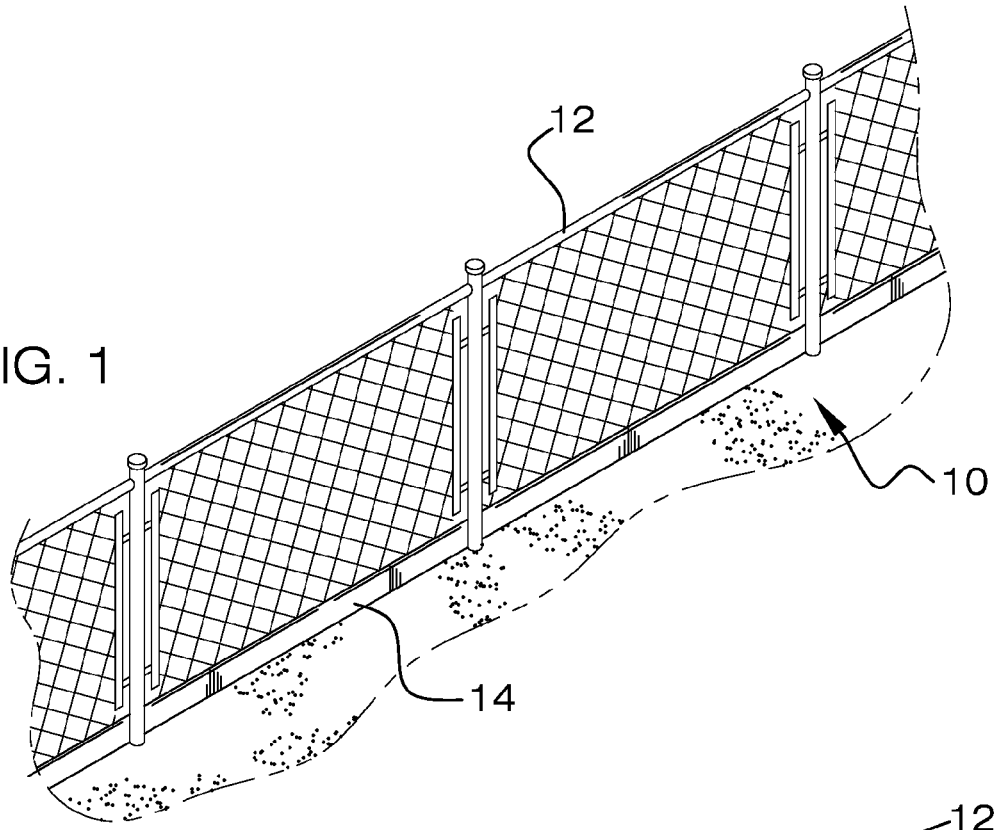
FIG. 1 is a perspective view of a conventional chain link fence with the fence edge guard in accordance with the present invention installed and positioned along the bottom edge of the fence.

Referring now to the drawings, and particularly to FIGS. 1-4, a preferred embodiment of the fence edge guard of the present invention is shown and is generally designated by the reference numeral 10.

In FIG. 1, a new and improved fence edge guard 10 of the present invention for preventing vegetation from growing up through the links of the fence, and for preventing damage and excess use of cutting line of a line trimmer is illustrated and will be described. More particularly, the fence edge guard 10 is shown in use along the bottom edge of a conventional chain link fence 12. It is generally preferred to install the fence 12 such that the bottom edge is spaced from the ground surface to prevent increased aging of the fence due to water exposure. As can be seen, the fence edge guard 10 extends substantially along the horizontal bottom edge of a section of the fence 12 and extends upwardly a few inches to cover a bottom portion of the bottom edge of the fence. In this manner, vegetation, such as weeds or grass is prevented from growing through the openings of the fence 12 which is covered by the fence edge guard 10. Further, the fence edge guard 10 provides a smooth surface against which the cutting line of the line trimmer can impinge without excess wear and damage to the cutting line. In describing the preferred embodiments of the present invention the description is directed primarily towards a conventional chain link type fence. However, it should be appreciated that the fence edge guard of the present invention is also compatible with other types of open weave wire fence and the like and as such the term chain link should not be interpreted for the purposes of this invention as being unduly limiting.

Figure 2:
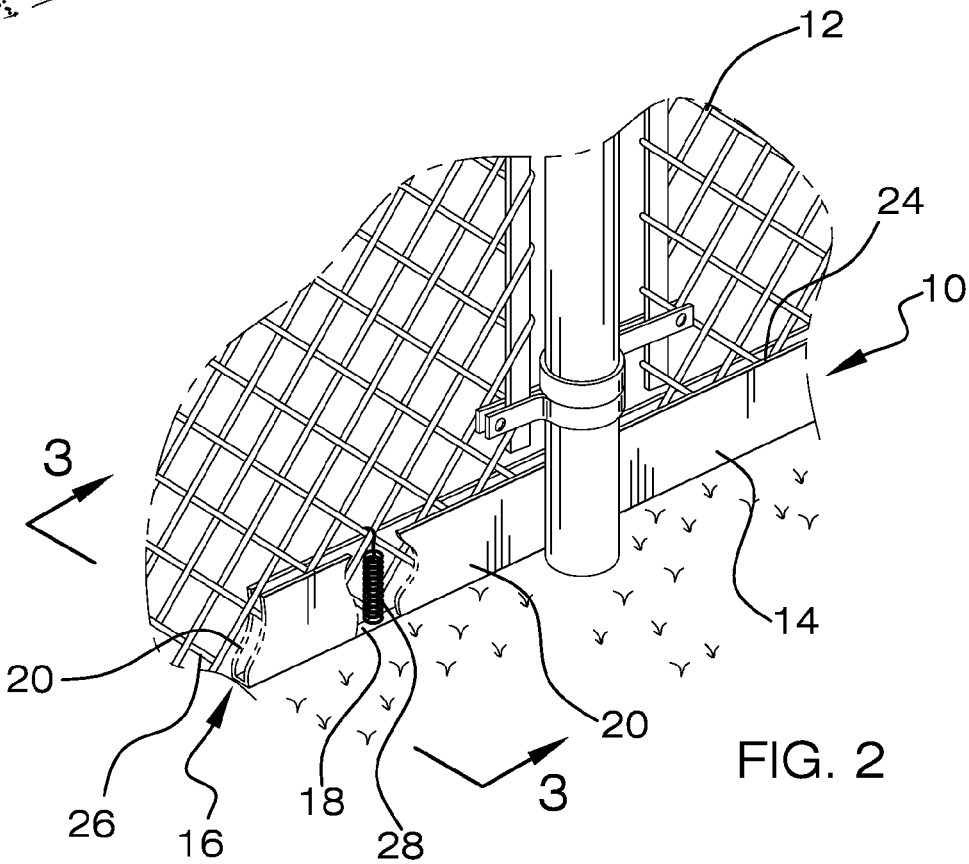
FIG. 2 is an enlarged perspective view of the fence edge guard attached and positioned along the bottom edge of the fence in partial cross-section to show one of a plurality of longitudinally spaced spring biased connector means that are used to positively secure the fence edge guard to the fence and urge the fence edge guard in an upward direction towards the bottom of the fence.
Figure 3:
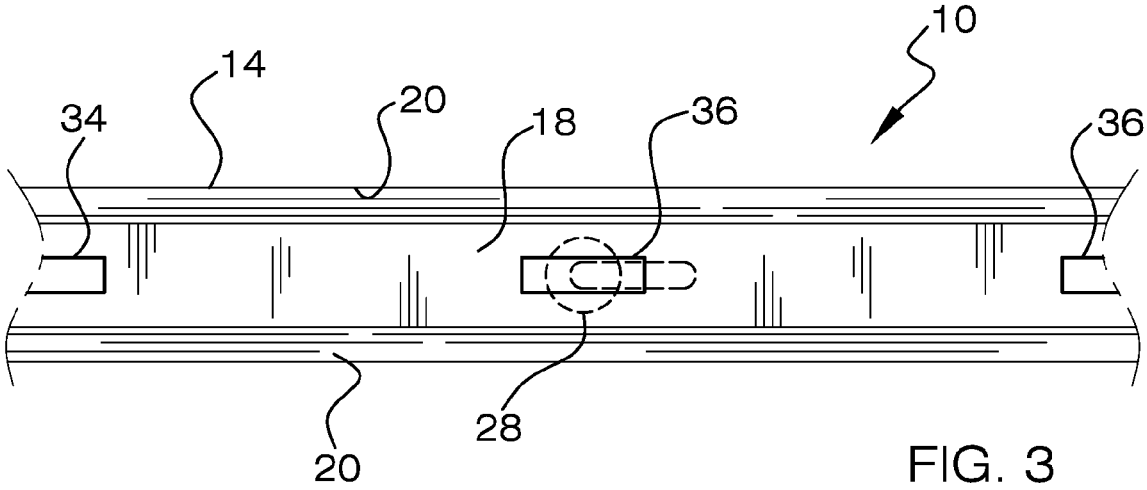
FIG. 3 is a cross-sectional view of the fence edge guard attached and positioned along the bottom edge of the fence.

In FIGS. 2 and 3, the fence edge guard 10 includes an elongated channel-shaped body 14 having an interior, elongated open channel space 16 defined by a horizontal bottom 18, and upstanding opposed sidewalls 20 that extend upwardly from opposed side edges 22 of the bottom and terminate at an open top 24. The sidewalls 20 are outwardly angled in a direction from the bottom 18 to the open top 24 such that the body 14 has a generally V-shaped cross-section in transverse. One sidewall may be shorter than the other to help facilitate installing the body 14 about the bottom edge of the fence. The body 14 may be made using conventional plastic extrusion methods. Alternatively, the body 14 may be made from extrude metal or metal alloys, or may be roll formed from a suitable stock material.

As can be seen, the bottom edge 26 of the fence 12 is positioned within the interior channel space 16 and extends upwardly therefrom through the open top 24. The sidewalls 20 extend upwardly along the bottom few inches of the fence 12. The body 14 is removably secured to the fence 12 by a plurality of longitudinally spaced spring biased connector means 28 positioned within the channel space 16 and which urge the bottom 18 upwardly towards the bottom edge 26 of the fence, and preferably space the bottom above the ground 30 providing a gap between the fence edge guard 10 and the ground. This gap is beneficial as it permits the cutting line of a line trimmer to extend underneath the fence guard 10 to trim vegetation away from the bottom edge 26 of the fence 12 providing a more appealing and neatly trimmed lawn, and further preventing vegetation from growing up and through the bottom of the fence. The aspect is not found with prior fence edge protectors where the means or method for attaching the fence edge protector allows the edge protector to sag below the bottom edge of the fence. In other words, prior fence edge protectors are not positively urged upwards against the bottom edge of the fence, and do not actively provide this beneficial gap.

Figure 4:
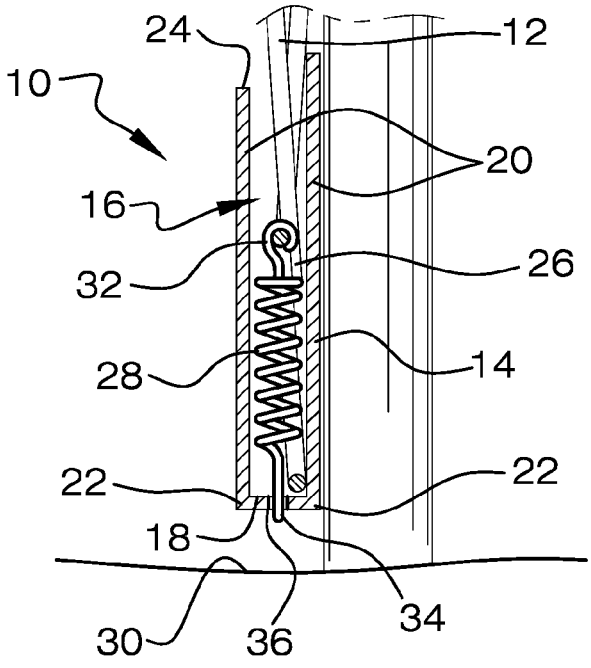
FIG. 4 is a partial bottom plan view of the fence edge guard.

The spring biased connector means 28 may include a coil spring having a first end 32 engagable with the fence 12 and a second end 34 engagable with the body 14. The first end 32 may be hook-shaped to engage a intersection of crossing wires, a link, of the fence 12. The second end 34 may be shaped to engage with one of a plurality of elongated slots 36 formed through the bottom 18 in longitudinal spaced relationship along the bottom, as shown in FIG. 4. In this manner, the fence edge guard 10 can be easily and readily installed on a fence without requiring any tools. The plurality of slots 36 also serve to drain trapped water from between the sidewalls 20 of the fence edge guard 10 when installed to a fence.

As it can be further seen, the channel space 16 is free from any connecting members extending between the sidewalls 20 above the bottom 18, which permits easier installation and maintenance of the fence edge guard 10.

In use, it can now be understood, a section of the fence edge guard 10 is installed on a fence 12 by inserting the bottom edge 26 thereof into the channel space 16 through the open top 24. Then the fence edge guard 10 rotated in a direction inwardly towards the fence 12 to fully position the bottom edge 26 into the channel space 16. The fence guard 10 is then secured to the fence 12 and is urged upwardly by a plurality spring biased connector means 28 spaced longitudinally along the fence edge guard.

A number of embodiments of the present invention have been described. Nevertheless, it will be understood that various modifications may be made without departing from the spirit and scope of the invention. Accordingly, other embodiments are within the scope of the following claims.

What is claimed is:

1. A fence and guard assembly comprising:

a chain link fence having links and a bottom edge;

a fence edge guard having an elongated channel-shaped body member of extruded plastic; said body member having a planar and horizontal bottom, a planer and upstanding sidewalls extending upwardly from opposed side edges of said bottom and terminating at an open top, and an open longitudinal channel defined by said bottom and said sidewalls; said sidewalls outwardly angled in a direction from said bottom to said top; a plurality of longitudinally spaced openings along said bottom; a plurality of coil springs spaced longitudinally along said body, each coil spring having a first end engaged with the chain link fence, and a second end engaged with one of said plurality of longitudinally spaced openings; said body member being free from an interconnecting members extending between said sidewalls above said bottom;

wherein said springs secure said body along the bottom edge of the chain link fence such that said bottom is urged upwardly towards the bottom edge of the chain link fence to prevent damage to a cutting line of a line trimmer and to prevent vegetation from growing up through the links of the fence.

2. The fence and guard assembly of claim 1, wherein one or more of said longitudinally spaced openings extend though said bottom of said body member forming drain holes.

3. The fence and guard assembly of claim 1, wherein said sidewalls are outwardly angled in a direction from said bottom to said open top such that said body has a V-shaped transverse cross-section.

4. The fence and guard assembly of claim 1, wherein one of said sidewalls is shorter than the other sidewall.

* * * * *